United States Patent [19]

Bergland

[11] 4,343,096

[45] Aug. 10, 1982

[54] SYSTEM FOR CONTROLLING EMISSIONS OF A SOLVENT FROM A PRINTING PRESS

[75] Inventor: Paul W. Bergland, Montville, N.J.

[73] Assignee: Bobst Champlain, Inc., Roseland, N.J.

[21] Appl. No.: 210,277

[22] Filed: Nov. 25, 1980

[51] Int. Cl.[3] ..... F26B 21/10

[52] U.S. Cl. ..... 34/47; 34/48; 34/77; 34/79; 118/61

[58] Field of Search ..... 34/26, 28, 29, 32, 72, 34/79, 47, 48; 432/72; 118/61

[56] References Cited

U.S. PATENT DOCUMENTS

| | | | |
|---|---|---|---|
| 2,554,239 | 5/1951 | Caulfield et al. . | |
| 2,791,039 | 5/1957 | Rosenbaum . | |
| 2,795,054 | 6/1957 | Bowen | 34/72 |
| 2,932,092 | 4/1960 | Rosenbaum . | |
| 3,757,427 | 9/1973 | Wilkinson | 34/72 |
| 3,909,953 | 10/1975 | Hemsath | 34/72 |
| 4,150,495 | 4/1979 | Stern . | |
| 4,176,162 | 11/1979 | Stern . | |

*Primary Examiner*—Larry I. Schwartz

*Attorney, Agent, or Firm*—Hill, Van Santen, Steadman, Chiara & Simpson

[57] ABSTRACT

A system for controlling the emission of solvents from a printing press having a plurality of printing stations characterized by the solvents being evaporated from the ink solution in a drying hood or section of each of the printing presses and the volatile organic compound of the solvents being converted into harmless gases by heating in an oxidation chamber. The exhaust from the oxidation chamber is recirculated back to the drying hoods so that the amount of fresh air being brought into the system is minimized to reduce the amount of exhaust gases being discharged back to the atmosphere to minimize the amount of the volatile organic compounds being discharged to the atmosphere.

5 Claims, 1 Drawing Figure

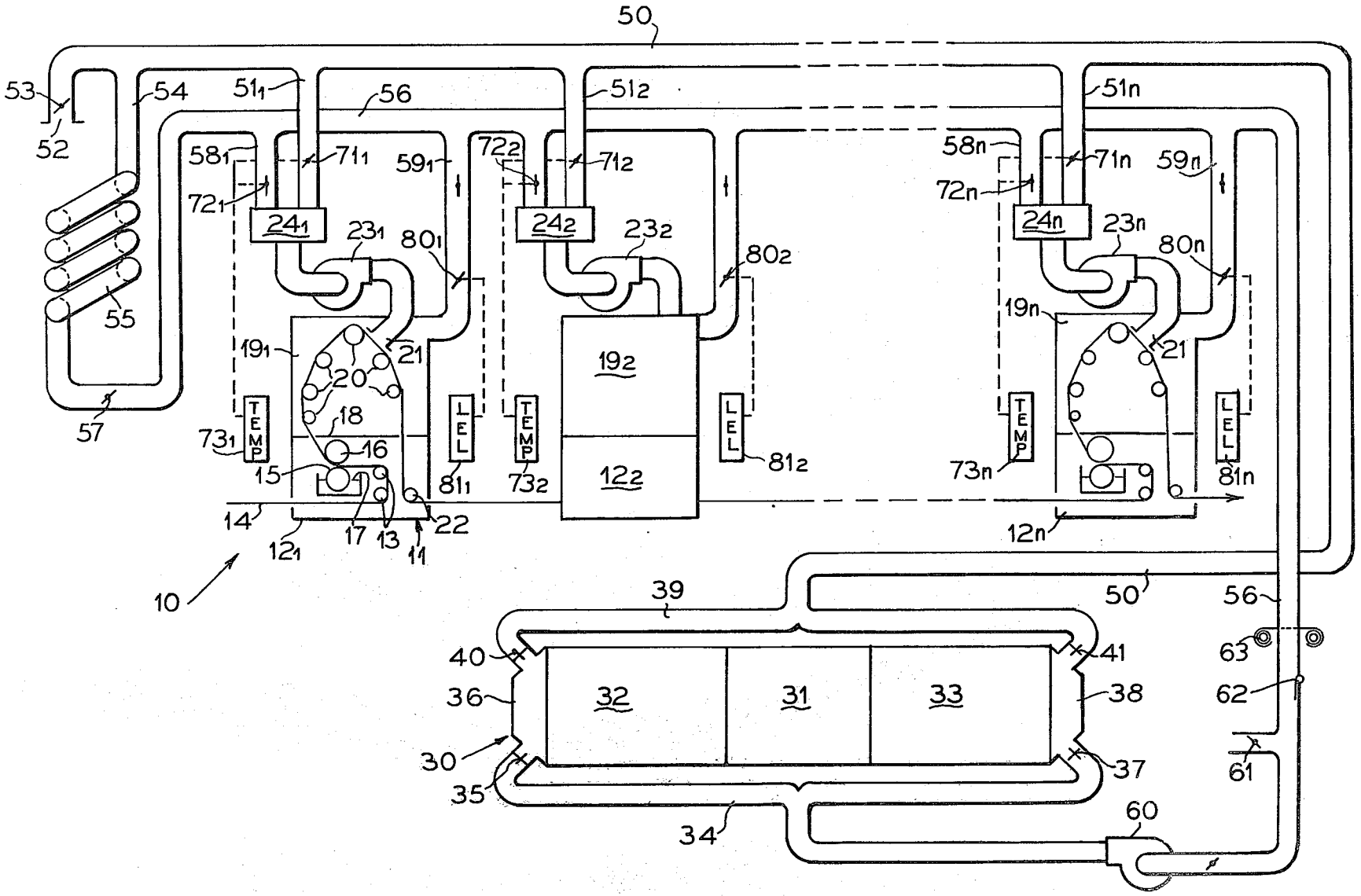
LEL
TEMP
10
11
12n
12₁
12₂
13
14
15
16
17
18
19n
19₁
19₂
20
21
22
23n
23₁
23₂
24n
24₁
24₂
30
31
32
33
34
35
36
37
38
39
40
41
50
51n
51₁
51₂
52
53
54
55
56
57
58n
58₁
59n
59₁
60
61
62
63
71n
71₁
71₂
72n
72₁
72₂
73n
73₁
73₂
80n
80₁
80₂
81n
81₁
81₂

SYSTEM FOR CONTROLLING EMISSIONS OF A SOLVENT FROM A PRINTING PRESS

BACKGROUND OF THE INVENTION

The present invention is directed to a system for controlling emission of a solvent from a printing press having a plurality of printing stations with each station being provided with a drying hood which is connected to an exhaust manifold going to an oxidation chamber for oxidizing the solvents from the drying gas with the exhaust of the oxidation chamber being recirculated back for use in the drying hoods.

In a printing press, after the ink solution has been deposited on the web, the web is passed through a dryer. The dryer will include an enclosure or hood in which a heated air or gas is passed over the web to evaporate the solvent from the depositing solution. Known structures of the dryer with the various nozzle configurations are disclosed in U.S. Pat. Nos. 2,554,239, 2,791,039, and 2,932,092.

The exhaust from each of these drying devices or hoods will include a volatile organic compound of the solvent which are removed during the drying process. Air pollution standards require that the solvents present in the exhaust gases from the dryers of the press be removed prior to releasing the exhaust gases into the environment. To remove the volatile organic compounds from the exhaust, two different types of approaches have been suggested. One is to attempt to recover the solvents, however, this recovery is limited to only certain types of solvents. The second method is to remove the solvents by heating the exhaust gases to a temperature of about 1400° F. If the gases are held at this temperature for approximately 0.6 seconds, about 99% of the solvents are converted into harmless water vapor and carbon dioxide. An example of a system and device for thermal oxidation of the volatile organic compounds in the gases is disclosed in U.S. Pat. No. 4,176,162.

Since the energy requirements to operate conventional pollution control system in which the volatile organic compound are oxidized in an oxidation chamber or incinerator such as disclosed by U.S. Pat. No. 4,176,162 are a direct function of the amount of air processed through the device for clean-up, these devices utilize a lower explosive limit (LEL) control unit. The lower explosive limit control unit measures the concentration of the volatile organic compounds in the dryer exhaust at each hood and recirculates the dryer exhaust back through the nozzle with a mixture of fresh air so that the volatile organic concentration levels are maximized but do not exceed a level at which a danger of explosion would occur. Thus, the amount of the volatile organic compounds return to the atmosphere is a function of the following two factors or variables of the process which are the clean up efficiency of the oxidation device, and the amount of fresh air introduced into the process to control the concentration of the volatile organic compounds at the point of the exhaust from the dryer hoods. This second factor is critical because the basic system requires that all fresh air introduced into the system must be returned to the atmosphere after processing through the dryer hoods or the like in order to maintain a balanced system.

In the drying hood of a conventional system, the normal air flow at the drying hood is to withdraw the air required for drying from the hood, heat the withdrawn air and return it through the drying nozzles back into the hood. The heat of this case can either be from an external source or by mixing the hood air with hot air from the exhaust of the volatile organic compound reduction device. In either case, a small amount of air is withdrawn from each hood to maintain a system balance. Should the volume of the volatile organic compounds emitted from one hood be large, an LEL control unit, such as disclosed in U.S. Pat. No. 4,150,495, will measure the concentration and increase the volume of fresh air being introduced into the hood. Such an increase in the volume of fresh air to the system will increase the volume of air that must be returned to the atmosphere from the system.

The conventional pollution control system such as disclosed in the above mentioned U.S. Pat. No. 4,176,162, when used with rotogravure packaging industry has a clean-up efficiency of between 90%–95%. This efficiency is calculated by measuring the concentration of the volatile organic compounds in the dryer air stream leaving the basic process and comparing that concentration to the concentration of volatile organic compounds leaving the pollution control device and being emitted into the atmosphere. The current trend in pollution control legislation is to define the limit on the amount of the pollutants that can be emitted into the atmosphere whereas in the past, the requirements are usually pointed at a percentage clean-up or reduction in the total emissions. Therefore, if the user of a volatile organic compound is to satisfy current environmental protection agency legislation, the user can either limit his usage to the point where the conventional system can satisfy the total emission requirements or the user must obtain a new system.

SUMMARY OF THE INVENTION

The present invention is directed to a system for controlling emissions of a solvent from a printing press having a plurality of printing stations, which system minimizes and controls the amount of fresh air input to the system to maintain the proper system balance and therefore minimizes the volume of air returned to the environment. In addition, the new system utilizes recirculated air which was cleaned up in the volatile organic compound reduction means instead of recirculating the air from the dryer hoods so that the concentration level of the volatile organic compound is diluted prior to being heated and returned to the hood. This dilution eliminates the need of fresh air introduction to maintain the desired lower explosion limit in the gases of the hood.

To accomplish these tasks, the present invention is directed to a system for controlling the emissions of a solvent from a printing press having a plurality of printing stations, said system including a separate drying hood for each of said printing stations, each of said drying hoods having means for moving a web of material through the hood, nozzle means for directing a flow of drying gases onto the moving web of material in the hood, blower means having a gas inlet for creating the flow of gas through said nozzle means, and a gas discharge outlet from said hood; means for removing solvents from a flow of gas, said means having inlet means for receiving the flow of gas containing solvents and outlet means for discharging said gas substantially free of said solvents; an output manifold having a first inlet connected to the outlet means, said manifold having a plurality of discharge outlets with one outlet for communication with each of the gas inlets for the blower means of each of said hoods, an adjustable outlet for discharging gas to the atmosphere and a terminal outlet; an exhaust manifold having a first inlet, a plurality of discharged outlets with one outlet for communication with each gas inlet of the blower means of each hood, a plurality of exhaust inlets with one exhaust inlet in communication with each gas discharge outlet of each hood, said exhaust manifold terminating in means for producing a negative pressure in said manifold, said means for producing discharging into the inlet means of said means for removing; and means for interconnecting the first inlet of the exhaust manifold to the terminal outlet of the output manifold so that the gas flow through the nozzle means of each hood is a mixture of gas from the output and exhaust manifolds and the exhaust from each hood is processed in the means for removing and then discharging into the output manifold for recirculation through the system.

Preferably, the means for removing the solvent or the volatile organic compound is by a thermal process of oxidation so that the gas is in the output manifold are elevated temperature. In order for the gases in the exhaust manifold to be at a lower temperature than those in the output manifold, preferably the means for connecting includes a heat exchanger. In order to adjust the amount of the mixture of the gases flowing through the nozzle means, the gas inlets for the blower means preferably includes means for adjusting the amount of gas coming from the output manifold and the exhaust manifold. This adjustment means enables adjusting the temperature of the gas in the flow through the nozzle means.

DESCRIPTION OF THE DRAWING

The FIGURE diagrammatically illustrates a system for controlling emissions of a solvent from a printing press having a plurality of printing stations in accordance with the present invention.

DESCRIPTION OF THE PREFERRED EMBODIMENTS

The principles of the present invention are particularly useful in a system generally indicated at 10 in the FIGURE for controlling the emissions of solvents such as volatile organic compounds from a printing press generally indicated at 11 which includes a plurality of printing stations $12_1, 12_2, \ldots 12_n$. Each of the printing stations $12_1, 12_2, \ldots 12_n$ is provided with a drying hood or chamber $19_1, 19_2, \ldots 19_n$.

Each of the printing stations such as $12_1$ has idler rolls such as 13 for guiding a web of material 14 between a roll 15 and a pressure roll 16. The printing roll 15 receives a printing fluid or ink from a supply 17. After passing through the rolls 15 and 16, the web passes through a slot in a bulkhead or partition 18 which separates the printing station from the interior of the drying hood or chamber 19.

Each of the drying chambers, such as the drying chamber 19, has a plurality of rollers 20 for guiding and conveying the web in a U-shaped path so that it may be subjected to a flow of drying gases or air from a nozzle means diagrammatically illustrated at 21. After passing through from the drying chamber 19, the web passes back through another slit in the bulkhead 18 over an idler 22 to the next printing station such as $12_2$.

To provide a flow of heated drying gases or air through the nozzle means 21, a blower means 23 which may be a fan blower is provided and has an inlet 24 for receiving the gas or air to be passed through the nozzles. The actual construction of the nozzles and the necessary manifolds for the nozzle means may be that of the conventional drying hoods or that illustrated in U.S. Pat. Nos. 2,554,239, 2,791,039, and 2,932,092, whose disclosures are incorporated by reference thereto.

The system 10 includes a means or unit for removing the solvent from the air which is generally indicated at 30. The unit or device 30 has an oxidation chamber 31, which is interposed between two regeneration chambers 32 and 33, which are pebble beds heat generators. In addition, the device includes an inlet means 34 which is in communication through a valve 35 with a header 36 for the regeneration chamber 32 and is in communication by a valve 37 with a header 38 for the regeneration chamber 33. An outlet means 39 is in communication with the header 36 through closable valve 40 and with the header 38 through a closable valve 41. Briefly, the device 30 is constructed to receive exhaust gas from the dryers through the inlet means 34 which connected to pass the gas through the valve 35 to the header 36 and into the regeneration chamber 32 to be preheated before reaching the oxidation chamber 31. In the oxidation chamber 31, the volatile organic compounds are oxidized and the heated or oxidized gases are then conveyed through the regeneration chamber 33 for heating the pebble bed and then out through the valve 41 into the exhaust means 39. In this form of operation, the valves 37 and 40 are closed. After a period of time, the valves 35 and 41 are closed and the valves 37 and 40 are opened so that the flow is in the opposite direction. The actual structure and a more detailed discussion of the operation of the device is contained in U.S. Pat. No. 4,176,162, whose disclosure is incorporated by reference thereto.

The outlet means 39 is connected to an inlet for an output manifold 50 which has a plurality of discharged outlets $51_1, 51_2, \ldots 51_n$, an adjustable outlet 52 having a control means such as a valve 53, and a terminal outlet 54. As illustrated, the plurality of discharged outlets $51_1, 51_2, \ldots 51_n$ are in communication with the gas inlets $24_1, 24_2, \ldots 24_n$, respectively. The terminal outlet 54 is in communication with a heat exchanger 55 which cools the gases from the output manifold 50 and discharges them into an exhaust manifold 56 through a flow control device illustrated as a valve 57. The exhaust manifold 56 has a plurality of discharge outlets $58_1, 58_2, \ldots 58_n$, which are in communication with the gas inlets $24_1, 24_2, \ldots 24_n$, respectively. In addition, the manifold 56 has a plurality of exhaust inlets $59_1, 59_2, \ldots 59_n$ which are in communication with the hoods $19_1, 19_2, \ldots 19_n$, respectively. Finally, the exhaust manifold 56 terminates in a system fan 60 which creates a negative pressure in the exhaust manifold 56, and a discharges into the inlet means 34 of the unit 30. It is noted, that the exhaust manifold 56 includes an adjustable bleed orifice 61, a fire damper 62, and a replaceable filter 63. It should be noted that each of the exhaust inlets $59_1, 59_2, \ldots 59_n$, includes valves or dampers such as $80_1, 80_2, \ldots 80_n$, which enable controlling the amount of negative pressure created in each of the hoods $19_1, 19_2, \ldots 19_n$, by the system fan 60 which forms means for creating a negative pressure in the chambers of the hoods.

As illustrated, the inlet such as $24_1$ is connected both to a discharge outlet $51_1$ of the output manifold 50 and to a discharge outlet $58_1$ of the exhaust manifold 56. Each of these outlets is provided with valve means such as a damper $71_1$ for the outlet $51_1$ and the damper $72_2$ for the outlet $58_1$. By adjusting the positions of these dampers, the amount of gas that is pulled into the gas inlet $24_1$ from each of the manifolds 50 and 56 can be adjusted to change the amount of mixture of the gas being directed through the nozzle means 21 by the blower means 23. As pointed out hereinabove, when the heat exchanger 55 is provided, the temperature of the gas in the exhaust manifold 56 is below those of the output manifold 50 and therefore changing the percentage of the gas from each manifold being passed by the blower means to the nozzle means will vary the temperature. If desired, a temperature control such as $73_1$ can be connected to operate the valves 71 and 72 in response to sensed temperature conditions.

In addition, each of the exhaust inlets $59_1, 59_2, \ldots 59_n$ is provided with an automatic control for the valve $80_1, 80_2, \ldots 80_n$ which is connected to a control means $81_1, 81_2, \ldots 81_n$ that is illustrated as a lower explosion limit (LEL) control device. The arrangement of the valve $80_1$ in the device $81_1$ acts as a means to control LEL to a preset level or a safety arrangement which will shut down the entire system should the concentration of the volatile organic compounds in the hoods such as $19_1$ reach an undesirable maximum limit. The structure and operation of the LEL control is described in greater detail in U.S. Pat. No. 4,150,495, and the disclosure of this patent is incorporated herein by reference thereto.

The device operates in the following manner. Starting with the outlet means for the device 30, the cleaned up emissions of the device 30 which are at an elevated temperature have a portion which is passed through the various discharged outlets $51_1, 51_2, \ldots 51_n$, a second portion which is discharged through the outlet 52 to the atmosphere and a third portion which passes through the heat exchanger into the exhaust manifold 56. Thus, the air, that is being passed through the nozzle means in each drying hood, will be a mixture of air from the exhaust manifold plur air from the output manifold. After passing through the nozzle, the air or gas is then exhausted back into the exhaust manifold. While the air or gas in the exhaust manifold 56 will have a slightly higher concentration of the volatile organic compound, the concentration will not approach the concentrations of the prior art systems. As the gas in the manifold 56 is drying by the means for creating a negative pressure 60, it is then passed into the device 30 which will oxidize the volatile organic compounds. As noted in the above mentioned U.S. Pat. No. 4,176,162, a minimum concentration is necessary for the oxidation in the chamber 31 to occur without the addition of fuel. In the present system, it is noted that this minimum percentage of the LEL which is roughly 6% LEL will not be met and therefore the unit 30 will require the burning of fuel to maintain the oxidation in the chamber 31. It should be noted that these units, such as disclosed in the above mentioned patents do have burners provided which enable them to operate when the gas being processed is below the self sustaining point of the oxidation chamber.

In the present system for a given printing press site and location, one needs to know the following criteria. The number of printing stations being used and the maximum volume of volatile organic compounds which can be emitted to the atmosphere for a given period of time. The number of printing stations being used will establish the volume of air that must be returned to the atmosphere. While the volume per station may be varied slightly, it is usually about 500 SCFM per station. By dividing the maximum volume of volatile organic compounds which may be released to the atmosphere by the volume of air that must be returned to the atmosphere, the maximum concentration of the volatile organic compounds in the "cleaned-up" air can be established. By multiplying this concentration by 10 or 20, depending upon whether the basic clean up efficiency of the volatile organic compound reduction unit 30 is 90% or 95% will give the maximum concentration level of the volatile organic compounds in the flow of gas being delivered to the inlet means 34 of the unit 30. Finally by dividing the maximum volume of the volatile organic compounds required during a given period of time by the maximum concentration level or the volatile organic compounds would establish the constant volume of air that must be processed through the volatile organic compound reduction unit 30 which unlike conventional systems is treated as a constant volume unit with the volume of air processed through the unit being constant and independent of the contamination level of the input air.

With the above information, the total air emitted through the system through the outlet 52 is controlled by the valve or adjustment means 53. The fresh air entering the system primarily enters through the slots in the bulkheads such as 18 between the hood 19 and the printing units 12. Since a portion of the gases or air in the output manifold 50 is being discharged to the atmosphere, the amount of concentration of the volatile organic compounds in the gas in the output manifold 50 cannot exceed the concentration in the air being discharged to the atmosphere.

While the present system will be less efficient with the consumption of energy due to the requirements of providing fuel in the oxidation chamber 31 to obtain the desired temperature for oxidation, the system will be able to meet the restrictions concerning the maximum amount of volatile organic compounds which are discharged to the atmosphere. It is possible to further refine the system by providing means for controlling the volume of air being processed through the system either by sensing the volatile organic compound levels in the air being returned to the environment or by measuring the volatile organic compound levels in the input means to the reduction unit 30. Although this would not eliminate the energy requirements, it should substantially reduce them.

Although various minor modifications may be suggested by those versed in the art, it should be understood that I wish to embody within the scope of the patent granted hereon, all such modifications as reasonably and properly come within the scope of my contribution to the art.

I claim:

1. A system for controlling emissions of a solvent from a printing press having a plurality of printing stations, said system including a separate drying hood for each of said printing stations, each of said drying hoods having means for moving a web of material through the hood, nozzle means for directing a flow of drying gases onto the moving web of material in the hood, blower means having a gas inlet for creating a flow of gas through said nozzle means, and a gas discharge outlet from said hood; means for removing solvents from a flow of gas, said means having inlet means for receiving a flow of gas containing solvents and outlet means for discharging said gas substantially free of said solvents; an output manifold having a first inlet connected to the outlet means, said manifold having a plurality of discharge outlets with one outlet in communication with the gas inlet for the blower means for each of said hoods, an adjustable outlet for discharging gas to the atmosphere and a terminal outlet; an exhaust manifold having a first inlet, a plurality of discharge outlets with one outlet in communication with the gas inlet of the blower means of each hood, a plurality of exhaust inlets with one exhaust inlet in communication with each gas discharge outlet of each hood, said exhaust manifold terminating in means for producing a negative pressure in said exhaust manifold, said means for producing discharging into the inlet means of said means for removing; and means for interconnecting the first inlet of one exhaust manifold to the terminal outlet of the output manifold so that the gas flow through the nozzle means of each hood is a mixture of the gas from the output and exhaust manifold and the exhaust from each hood is processed in the means for removing and discharged into the output manifold for recirculation through the system.

2. A system according to claim 1, wherein said means for removing removes the solvent by a thermal process so that gases in the output manifold are at an elevated temperature and wherein the means for connecting includes a heat exchanger so that the gases in the exhaust manifold are at a temperature less than the temperature of the gases in the output manifold.

3. A system according to claim 2, wherein each of the gas inlets for the blower means includes means for adjusting the amount of the gas from both the exhaust manifold and the output manifold so that the temperature of the flow through the nozzle means can be adjusted.

4. A system according to claim 1, wherein each of the gas inlets for the blower means includes means for adjusting the amount of gas coming from the output manifold and the exhaust manifold so that the mixture of the flow through the nozzle means can be adjusted.

5. A system according to claim 1, wherein the means for removing comprises a means removing the solvent by a thermal process so that the gases in said output manifold are at an elevated temperature.

* * * * *